US005278375A

United States Patent [19]

Berteaud et al.

[11] Patent Number: 5,278,375

[45] Date of Patent: Jan. 11, 1994

[54] MICROWAVE APPLICATOR DEVICE FOR THE TREATMENT OF SHEET OR LAP PRODUCTS

[75] Inventors: André-Jean Berteaud, Draveil; Alain Germain, Bagneux, both of France

[73] Assignee: Microondes Energie Systemes, Rungis Cedex, France

[21] Appl. No.: 665,540

[22] Filed: Mar. 6, 1991

[30] Foreign Application Priority Data

Mar. 7, 1990 [FR] France ..... 90 02887

[51] Int. Cl.[5] ..... H05B 6/70

[52] U.S. Cl. ..... 219/693; 219/750; 333/233

[58] Field of Search ..... 219/10.55A; 10.55M, 10.55F, 10.55R, 10.61A, 10.61R, 10.55B; 333/233, 333/83R; 98M, 95, 76

[56] References Cited

U.S. PATENT DOCUMENTS

| | | | |
|---|---|---|---|
| 3,457,385 | 7/1969 | Cumming | 219/10.55 A |
| 3,560,694 | 2/1971 | White | 219/10.61 |
| 3,560,695 | 2/1971 | Williams | 219/10.61 |
| 3,632,945 | 1/1972 | Johnson | 219/10.61 |
| 3,672,066 | 6/1972 | Stephasen | 219/10.61 |
| 3,783,221 | 1/1974 | Soulier | 219/10.55 A |
| 3,851,132 | 11/1974 | VanKoughnett | 219/10.55 A |
| 4,128,751 | 12/1978 | Sale | 219/10.55 A |
| 4,259,561 | 3/1981 | Roussy et al. | 219/10.55 A |
| 4,501,944 | 2/1985 | Matsushima | 219/10.55 R |
| 4,822,967 | 4/1989 | Kumagami et al. | 219/10.55 F |
| 4,943,778 | 7/1990 | Osaki | 324/636 |

*Primary Examiner*—Bruce A. Reynolds
*Assistant Examiner*—Tu Hoang
*Attorney, Agent, or Firm*—Keck, Mahin & Cate

[57] ABSTRACT

A microwave applicator device for the treatment of sheet or lap products comprising a housing defining a parallelepipedal waveguide cavity with dimensions a×b×L in an orthogonal coordinate system Ox, Oy, Oz, the housing being aligned along Oz and provided with slots for passing the product to be treated into the cavity along a plane parallel to the Ox, Oz plane, and means a microwave generator for exciting the cavity in Transverse Electric Mode, in order to create an electric field (E) internal to the cavity along a direction substantially parallel to Ox. The housing is such that the dimension a of the cavity is greater than a value substantially equal to the dimension b of the cavity.

14 Claims, 3 Drawing Sheets

MICROWAVE APPLICATOR DEVICE FOR THE TREATMENT OF SHEET OR LAP PRODUCTS

BACKGROUND OF THE INVENTION

1. Field of the Invention

The present invention relates to a microwave applicator device for the treatment of sheet or lap products, of the type comprising a housing defining a parallelepipedal waveguide cavity with dimensions a x b×L in an orthogonal coordinate system Ox, Oy, Oz, the the housing being aligned along Oz and provided with slots for passing the product to be treated into the cavity along a plane parallel to the Ox, Oz plane, and means for exciting the cavity in transverse electric mode (TE), in order to create an electric field internal to the cavity along a direction substantially parallel to Ox.

By microwaves must be understood waves with frequencies lying between 0.3 GHz and 300 GHz, and more particularly those situated in the S-band [1.55 GHz to 5.2 GHz].

The invention finds a particularly important, though not exclusive, application in the field of the drying of sheet or thin lap products, that is to say of thickness less than of the order of 20 mm, especially in the fields of papermaking, printing (drying of inks), for the preparation of hides in the leather industry, or for the drying of damp powders laid out in laps. Microwaves of standard frequency equal to 2.45 GHz will be especially advantageously used.

However the invention can quite obviously be applied to other treatments and especially to heat treatments with differing microwave frequencies and on products in sheets of greater thickness.

2. State of the Art

Devices for microwave treatment of sheet products are already known. They most often call upon, either waveguide housings with so-called "winding", bent structure, or parallelepipedal waveguide housings, of the type defined above, slotted on the large sides for the passing of the product to be treated, this avoiding disturbance to the current lines of the fundamental mode of the electric field.

These known solutions allow a fairly homogeneous treatment, but, being able to employ only a low-intensity electric field, are either bulky and complicated (in the case of "winding" structures), or limited in their usage, since not allowing a working period sufficient for the desired treatment of the product (in the case of slotted guides). In the latter case, in fact, the known parallelepipedal "waveguide" housings possess a transverse cross-section of low width a; for example, the standard dimensions a×b of the transverse cross-sections of housings are 4.3 cm×8.6 cm in Europe, and 3.4 cm×7.2 cm in the United States. The sheet product which advances in the transverse sense through the slots of the housing, can therefore remain for only a limited period in the cavity excited in TE mode.

There could, quite obviously, be a temptation to raise the residence time by slowing the speed of advance, or even by stopping the product in the housing, for a specified period. However such a solution would be to the detriment of the homogeneity of treatment also desired. In fact, in the case of an applicator device with advance, it is possible to be content with an approximately uniform electric field over the whole width of the carrier band, without worrying about the direction of the advance, since there will be a statistical homogenising of the energy absorbed during traversal of the housing. This is no longer the case for a static applicator device.

To remedy the disadvantage of the low-intensity electric field and reduce the bulkiness of the applicator device, it has been possible to call upon a resonant applicator whose electric field is more intense for a given microwave power.

In fact, in the case of a resonant wave, the electric field is, as is known, multiplied by the square root of the overvoltage, the overvoltage being defined as the ratio between the total energy stored in the resonator and the energy dissipated per period (modulo 2 $\pi$).

However, use of a resonant applicator has the disadvantage of no longer allowing a homogeneous treatment over the whole width of the sheet product to be treated since the electric field possesses intensity nodes and antinodes.

To remedy this disadvantage, a system has been proposed consisting of at least two identical resonant waveguide cavities through which the sheet to be treated advances, and which are mutually offset by $(1/N)\times\lambda g/2$, in order to distribute the effect of the field maxima over the whole width of the product [FR No. 2,523,797].

If the latter solution is satisfactory, it can in particular be further improved. In fact, on the one hand it requires the presence of several guide cavities, on the other hand, it is known that resonant cavities often pose particular matching problems.

In fact, their functioning is closely dependent upon load variations, and a regulating of the frequency to the variations in intensity of the field is often necessary for a precise tuning to the resonance.

SUMMARY OF THE INVENTION

It is an object of the invention to provide an improved device for better meeting, than those previously known, the practical demands, especially in that it does not necessarily require a waveguide applicator of the resonant type, (but without excluding it absolutely). It is another object of the invention to allow substantial increase in the working period of the microwaves on the product to be treated, and this in a simple and inexpensive way, whilst obtaining improved yields, for example of drying, relative to the existing devices.

To this end, the invention provides more particularly a microwave applicator device for the treatment of sheet or lap products with microwaves comprising:

a housing defining a parallelepipedal waveguide cavity with dimensions a×b×L in an orthogonal coordinate system Ox, Oy, Oz, said housing being aligned along Oz and provided with slots for passing the sheet or lap products to be treated into the cavity along a plane parallel to the Ox, Oz plane, the dimension a of the cavity being greater than a value substantially equal to the dimension b of the said cavity ;

and means for exciting the cavity in Transverse Electric Mode (TE), in order to an electric field (E) internal to the cavity along a direction substantially parallel to Ox.

It is another object of the invention to provide a microwave applicator device for the treatment of sheet or lap products with microwaves comprising:

a housing defining a waveguide cavity, said housing comprising a first part of housing defining a parallelepipedal waveguide first part of cavity with dimensions a×b×L in an orthogonal coordinate system Ox, Oy, Oz, the first part of housing being aligned along Oz and provided with slots for passing the sheet or lap products to be treated into the cavity along a plane parallel to the Ox, Oz plane, the dimension a of the first of part of cavity being greater than a value substantially equal to the dimension b of said first part of cavity ;

and means for exciting the cavity in Transverse Electric Mode (TE), in order to create an electric field (E) internal to the cavity along a direction substantially parallel to Ox.

By value substantially equal to b, must be understood a value slightly greater than b, for example greater than 1.2 b.

For a given value of b which, as will be seen later, cannot be fixed arbitrarily since it depends on the wavelength used, this layout thus allows the treatment of an advancing product for a longer period than with the known devices (where the ratio a/b is smaller than or equal to 0.5). The action of microwaves occurs in fact over a larger distance. Likewise, in the case of a static product treatment, the product will be able to have a larger dimension along Ox, (parallel to the side a).

To impose this condition on the ratio a/b was in no way obvious to the man skilled in the art. In fact, it is known that a waveguide cavity with standard right cross-section a×b (for example 4.3 cm ×8.6 cm), excited in transverse electric mode (TE) transports the TE01 mode, that is to say such that the electric field is constant along Ox and has direction parallel to Ox.

This transverse electric mode is the desired mode with the devices for treating sheet products, especially for applications of the drying type, since it allows efficient and optimised action of the electric field on the product. (The electric field is then, in fact, in the plane of the sheet).

Now, it is also known that, when the value of the side a rises, the guide cavity begins to transport other energy distribution modes, and this once a registers a critical value ac which depends on the frequency f of the microwaves and on the dimension b.

It can be shown mathematically that this critical value ac, such that $ac=\lambda/2$, where $\lambda$ is the free-space wavelength of the microwaves employed. When a grows beyond ac and becomes greater than b, the TE10 mode for which the electric field is parallel to 0y (perpendicular to the plane of the sheet product) can exist equally well as the TE01 mode; and it can similarly be demonstrated that the larger a becomes compared to b, the more unstable becomes the TE01 mode relative to the TE10 mode.

In fact, in an altogether surprising manner, the inventors noticed experimentally that, contrary, on the one hand to what could have been learnt from the known devices, and on the other to what the above theoretical approach relating to the behaviour of microwaves in parallelepipedal housings defining a guide cavity advocated, high stability of the TE01 mode was obtained in parallelepipedal cavities of the type with lateral slots for introducing the sheet product along a plane Ox, Oz, for dimensions of a greater than a value substantially equal to b, and even several times greater than b. Nothing could have suggested such a layout to the man skilled in the art.

In an advantageous embodiment, the ratio a/b is greater than 2.

It was in fact, and in particular, possible to observe experimentally that the energy yield obtained with an overdimensioned waveguide cavity, where the side a is equal to 2 or 3 times the side b, wa markedly greater than that obtained with the standard guide of side a=43 mm.

Thus, the drying of a water-soaked blotter carried out in a standard guide is improved by 10 to 15% with an overdimensioned guide (90% with a=200 mm as regards 75% with a=43 mm).

In a likewise advantageous embodiment, the ratio a/b is greater than 4.

The interest in such a layout, apart from the increasing of the exchange period, lies in the fact that the internal field acting in the product tends to the applied field since the depolarising field tends to zero when the dimension a increases.

Now, surprisingly, as already indicated, it was possible to construct applicators such that the side a becomes equal to 350 mm and more, whereas b remained equal to the standard dimension of 86 mm, and this without losing the excitation of the single TE01 mode. The energy yields are, because of this, better still.

It is a further object of the invention to provide a device wherein the first part of housing is connected to a first complementary portion of housing defining a first complementary portion of cavity extending outwardly of the Ox, Oz plane in an outwardly direction, and wherein the housing comprises means for deviating the direction of microwaves propagation between the microwaves direction parallel to the Ox, Oz plane, within the first part of housing, and the outwardly direction, within the first complementary portion of cavity.

Such a disposition authorizes to add energy to the microwave from the top, or the bottom, of the device, and to change the direction of the microwave propagation without modifying the excitation in TE01 mode. Advantageously the outwardly direction is parallel to Oy.

Other objects of the invention are to provide the following arrangements :

the housing comprises an end portion aligned along the first part of housing, located on the other side of the first complementary portion of housing with regard to the first part of housing, and arranged for trapping the microwaves which are not deviated in the first complementary portion of cavity;

the housing comprises a second complementary portion of housing defining a second complementary portion of cavity, located within the proximity of the first complementary portion of housing an extending outwardly of the Ox, Oz plane, and a second part of housing defining a parallepipedal waveguide second part of cavity with dimensions a×b ×L' in the orthogonal coordinate system Ox, Oy, Oz, the second part of housing being aligned along Ox, Oz with said first part of cavity, on the other side of said first part of cavity with regard to the first and second complementary portions of housing, and the device comprises means for exciting the cavity in Transverse Electric Mode (TE), in order to create an electric field (E') internal to the cavity along a direction substantially parallel to Ox;

a plurality of parts of housing aligned along the Ox, Oz plane, each part being connected to a corresponding complementary portion of housing, are provided ;

the device comprises a first microwave generating means for introducing microwaves at one end of the part of housing and a second microwave generating means for introducing microwaves at the opposite end of the complementary portions of cavity.

Advantageously, the device according to the invention comprises means for advancing the product inside the cavity, in a direction parallel to Oz.

This is made possible by virtue of the large dimension of a. For example, if a=250 mm, it will be possible to advance a product of width nearly 250 mm (much greater than the 43 mm of the known devices) in the direction of propagation of the wave. This allows a particularly homogeneous effect to be exerted on the product, since the electric field is constant over the whole width of a.

In a likewise advantageous embodiment, the device is of the resonant type.

It is likewise possible to resort to the following advantageous layout: the length of the dimension b is less than the standard dimension, and close to the critical value bc=c/2f, known in the literature, where c is the speed of light in vacuo and f is the microwave frequency.

It is known, in fact, that in a rectangular guide propagating the TE01 mode, a relationship exists between the frequency of the wave, the dimension of the side b and the wavelength λg guided in the housing, a relationship which can be written:

$$\frac{1}{\lambda_g^2} = \frac{b^2}{c^2} - \frac{1}{4b^2}$$

where c designates the speed of light in vacuo. This expression shows that λg can become very large (stretching of the wave in the direction of propagation) by reducing b. The extreme case where λg becomes infinite, corresponds to the so-called cutoff condition where $$b = \frac{c}{2f}$$

namely 61.2 mm for f=2.45 GHz.

Without going as far as this minimal critical value of b (61.2 mm), the inventors have constructed an applicator with b=63 mm, which allows attainment of a guided wavelength λg of 480 mm and thus creation of a very homogeneous working field over about 100 mm. The applicator thus defined by virtue of the invention, has thus allowed the creation of a planar and homogeneous working zone of 100 mm by 200 mm.

In other embodiments, there is advantageously provision for the dimension b to be arranged in order to distribute the antinodes of the resonant wave in the longitudinal sense of the cavity, parallel to the axis Oz, in a specified manner.

This distribution is effected as a function of the wavelength of the wave used, from the preceding formula already indicated:

$$\frac{1}{\lambda_g^2} = \frac{b^2}{c^2} - \frac{1}{4b^2}$$

Another application connected with the control of λg as a function of b consists, in fact, in choosing b in such a way as to create energy antinodes situated exactly in line with parts of product to be preferentially treated.

Thus, in order to dry adhesive strips applied parallel to one another on an advancing support, b is chosen in such a way as to concentrate the microwave energy onto the strips to be treated. For a 75 mm spacing of the adhesive strips, the inventors have thus constructed a resonant applicator of side a=160 mm and of side b=103.5 mm, and obtained strip-drying performance levels greater than those which were generally observed for infrared or for high frequency.

In another advantageous embodiment, in contrast with certain preceding cases, the device is not of the resonant type.

It is moreover possible to advantageously resort to a housing with removable cover in the form of a plate with longitudinal edges turned down parallel to the Oy, Oz plane, the periphery of the longitudinal edges being parallel to the Ox, Oy plane, the cover thus constituting a portion of the lid of the housing.

In this case, the longitudinal edges of the cover advantageously coincide with the upper edge of the passing slots.

This is one of the other advantages of employing the TE01 node in an overdimensioned guide. The continuity of the current distribution over the walls of the housing is, in fact, preserved with such a cutout and no discharge phenomenon breaks out between the upper and lower parts, contrary to what would happen if the cutout were made differently.

By making the inside of the housing accessible, an important problem is moreover resolved, namely the problem of the "plugging" of advancing products, piling up on the insertion slot.

BRIEF DESCRIPTION OF THE DRAWINGS

The invention will be better understood on reading the following description of embodiments given by way of non-limiting examples. The description refers to the attached drawings in which.

DETAILED DESCRIPTION OF INVENTION

Figure 1:
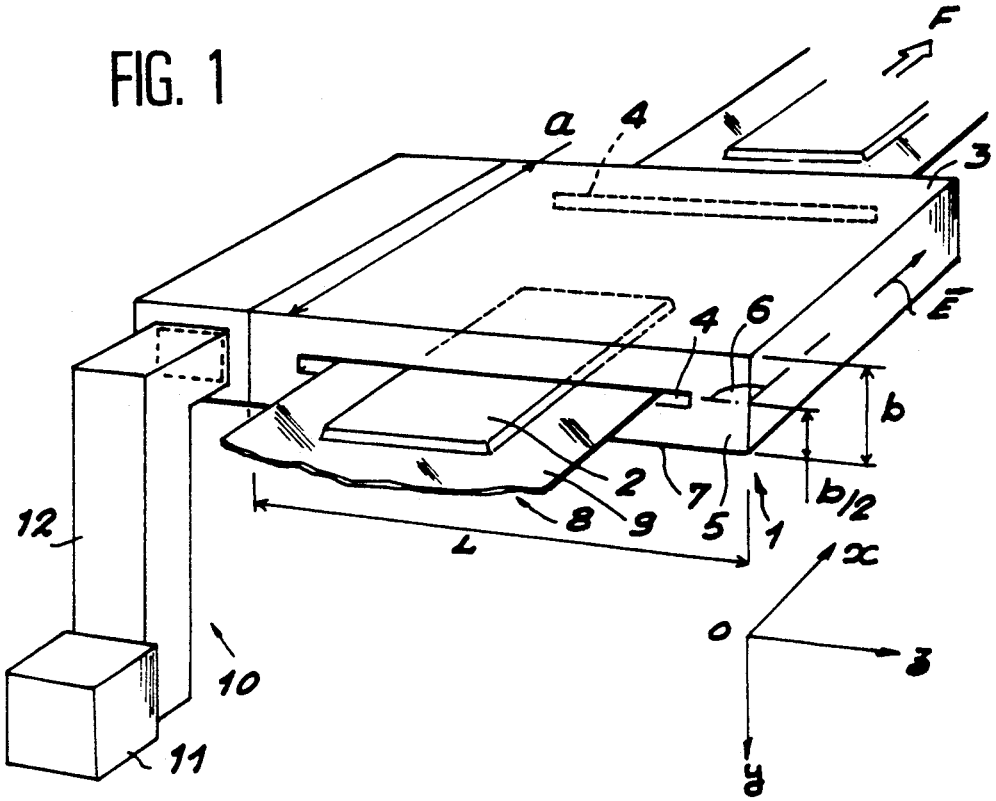
FIG. 1 is a perspective view of a non-resonant, applicator device for treating, according to a first embodiment of the invention, the sheet or lap product advancing in the direction of the Ox axis.

Referring to FIG. 1, there is shown a perspective view of a microwave applicator device 1 for the treatment of a sheet or lap product 2, according to a first embodiment of the invention. The applicator device comprises a housing 3 defining a parallelepipedal waveguide cavity of dimensions a×b ×L, in the orthogonal coordinate system Ox, Oy, Oz. The dimension a is greater than the dimension b, for example a is of the order of 3 b.

The housing 3 is aligned along Oz and provided with two rectangular slots 4, one on each of the large sides 5 of the housing. These slots serve in the passing of the product to be treated along a plane 6, parallel to the Ox, Oz plane, and situated, for example and advantageously, at a distance b/2 from the bottom 7 of the housing.

The product 2 is, for example, placed on advancing means 8 comprising a endless belt 9, known per se; however the product can, if it lends itself thereto, simply be tensioned between two mandrels (not represented), in order to advance continuously or batchwise through the slots 4, across the cavity.

Means 10 for exciting the cavity in transverse electric mode, that is to say such that the electric field E is perpendicular to the direction of propagation of the microwaves emitted and guided in the cavity, are provided. They comprise, in a known manner, a magnetron, or microwave generator, 11 and a guide 12 for transferring the waves to the cavity; these means of excitation generate microwaves, for example, in the 2.45 GHz band, and create an electric field internal to the cavity of dimension a×b×L with a power, for example, of I KW. Surprisingly, and as has been seen, this field E takes up a direction substantially parallel to Ox (that is to say it remains in TE01 mode), and this in spite of a dimension a greater than b.

For example, by using the above 2.45 GHz frequency, for which it is recalled that the standard guide is such that a=43 mm and b=86 mm, the inventors have constructed applicator housings such that a=250 mm (and more), b remaining equal to 86 mm, without losing the excitation in TE01 mode. In this case, the product to be treated while advancing as in FIG. 1, therefore remains interacting with the electric field E for a period multiplied by the ratio 250/43, relative to the period spent in a standard guide.

Figure 2:
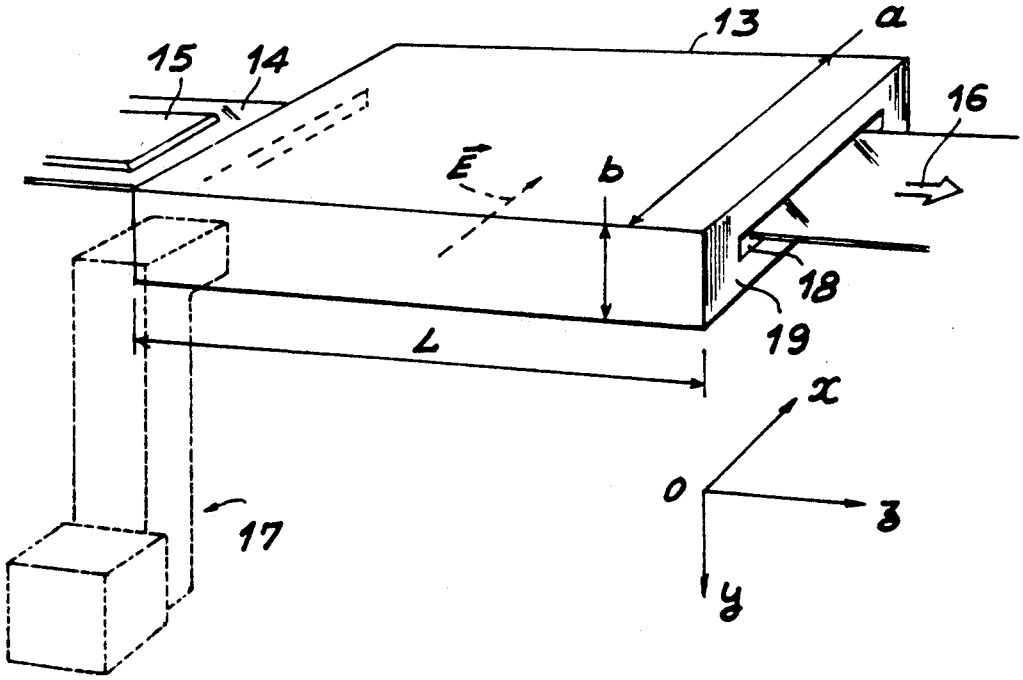
FIG. 2 is a perspective view of a second embodiment of a device according to the invention, with the sheet, or lap product advancing in the direction of the Oz axis.

In FIG. 2, there has been represented a housing 13 comprising means 14 for advancing the product 15 inside the cavity, in a direction 16 parallel to Oz. The microwave generating means 17, schematically represented by dashed lines in FIG. 2, are provided on the side of the housing, as indicated in the figure, so as not to interfere with the advance.

The housing 13 comprises two parallel and rectangular slots 18 on the two small lateral sides 19 of the housing.

Figure 3:
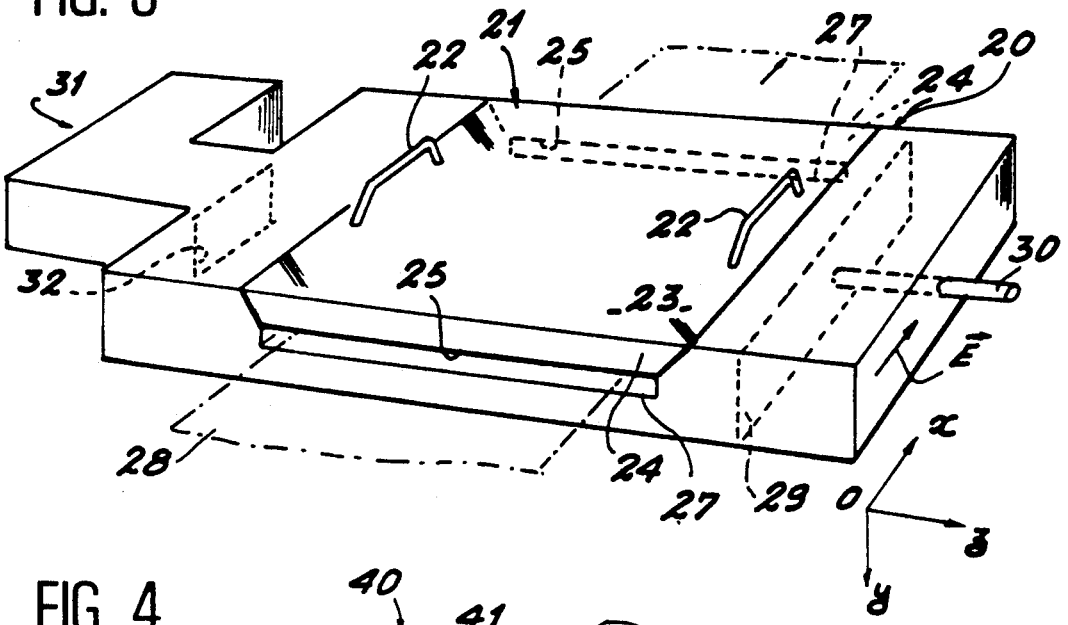
FIG. 3 is a perspective view of a third embodiment of the device of the invention, comprising an applicator housing with resonant cavity, and opening lid.

FIG. 3 shows a third embodiment of the invention comprising a resonant housing 20, provided with a removable cover 21 comprising grasping means 22, for example handles. The cover 21 is in the form of a plate 23, with longitudinal edges 24 turned down parallel to the Oy, Oz plane.

The cover is designed so that the peripheries 25 of the longitudinal edges constitute the upper edges of the rectangular slots 27 for passing the product 28 (in chain-dotted lines in the figure) to be treated, the product itself advantageously advancing in a plane situated at a distance b/2 from the bottom of the housing.

In FIG. 3 there has likewise been represented in dashed lines a movable waveguide plunger 29, disposed at one of the longitudinal ends of the housing, and which can be actuated through a rod 30 in order to make the housing resonant. Moreover, so as to match the load seen by the wave generator schematically represented at 31, and in a manner known per se, a capacitive and/or inductive impedance is provided at the other end of the housing, on the generator 31 side. It is for example an iris 32 (in dashed lines in the figure).

The capability to remove the lid of the housing which, by its design, proves not to be disturbing to the current lines crossing its surface, is a not insignificant advantage.

Figure 4:
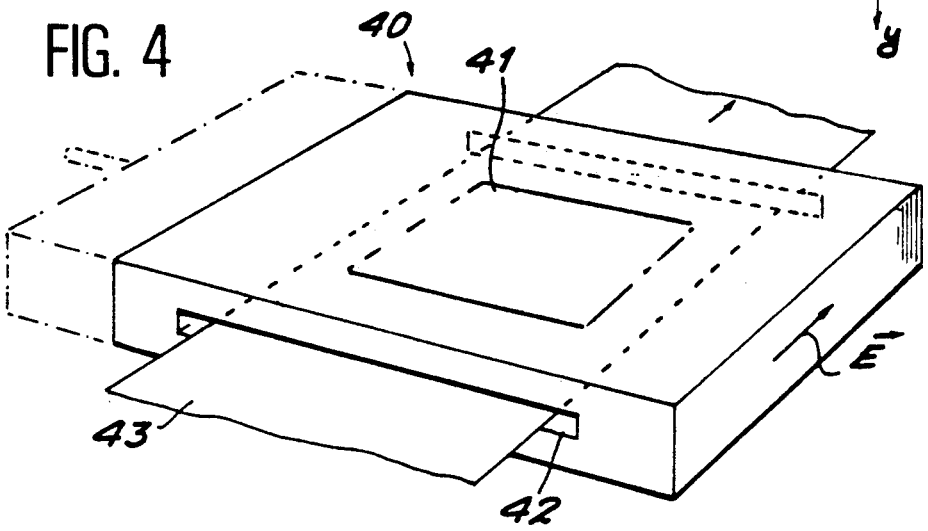
FIG. 4 shows schematically a resonant housing, according to another embodiment of the invention, more particularly designed to treat a wide static product zone.

FIG. 4 is a schematic view of a resonant housing 40 with reduced dimension b, close to the critical value c/2 f, this allowing homogeneous treatment of a large area of product 41, for example 100 by 200 mm, as described above.

The product is inserted batchwise via the slots 42 on a endless belt 43.

Figure 5:
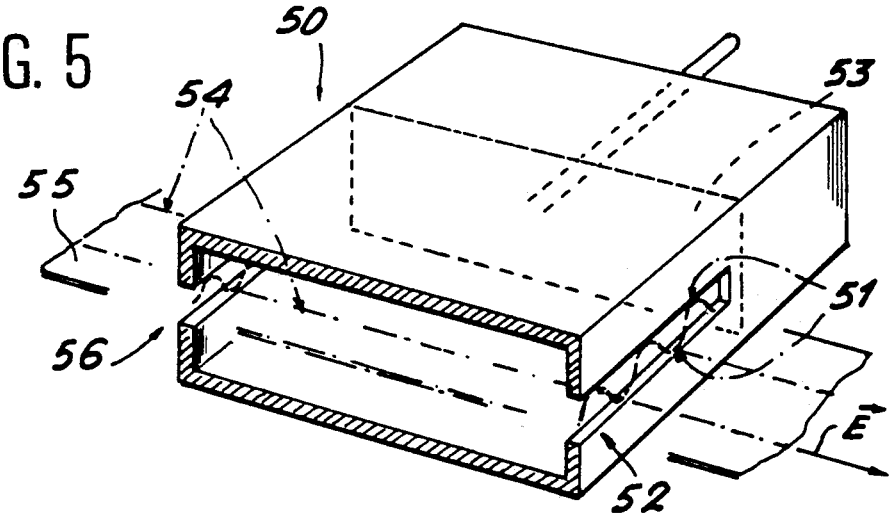
FIG. 5 is a sectional view of a resonant housing designed to treat product parts with precise positioning of the energy antinodes of the microwaves emitted in the cavity of the housing.

FIG. 5 shows in section, a resonant housing 50 according to another embodiment of the invention.

The antinodes 51 of the resonant wave 52, the spacing of which is adjusted, in a manner known per se, by way of the waveguide plunger 53 (in dashed lines in FIG. 5) are arranged so as to be positioned in line with the zones 54, to be treated, of the sheet product 55 which advances via the longitudinal slots 56 of the housing.

Figure 6:
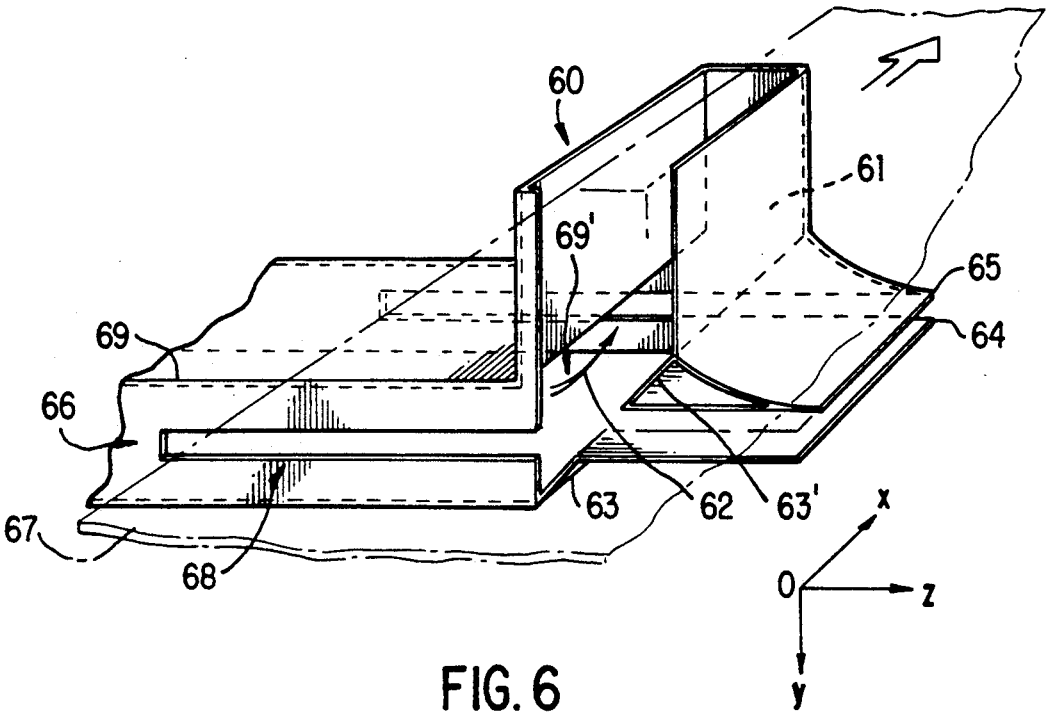
FIG. 6 is a perspective view, partially in section, of another embodiment of the invention with a vertical complementary portion of housing and a lateral microwaves trap.

Referring to FIG. 6, it is shown an other embodiment of an housing 60 according to the invention comprising a vertical first complementary portion of housing 61 within which microwaves change their direction of propagation 62 due to two flaps 63, 63', inclined at an angle of 45° with the horizontal, and two plates 64, 65, for trapping the microwaves which are not deviated by the two flaps situated in the same plane and at a distance form each other for letting the product pass along Ox, Oz.

The waves introduced on the left side 66 of the FIG. 6, follow a vertical path in portion 61, the products 67 to be treated being introduced in the slot 68 for lateral treatment in the first part of housing 69 defining a parallelepipedal cavity 69' with dimensions a×b×L in a coordinate system Ox, Oy, Oz. It has therefore been possible to better dry the periphery of a cardboard type product which is always wetter than the central part of the lap, due to air contact or bad storage.

Figure 7:
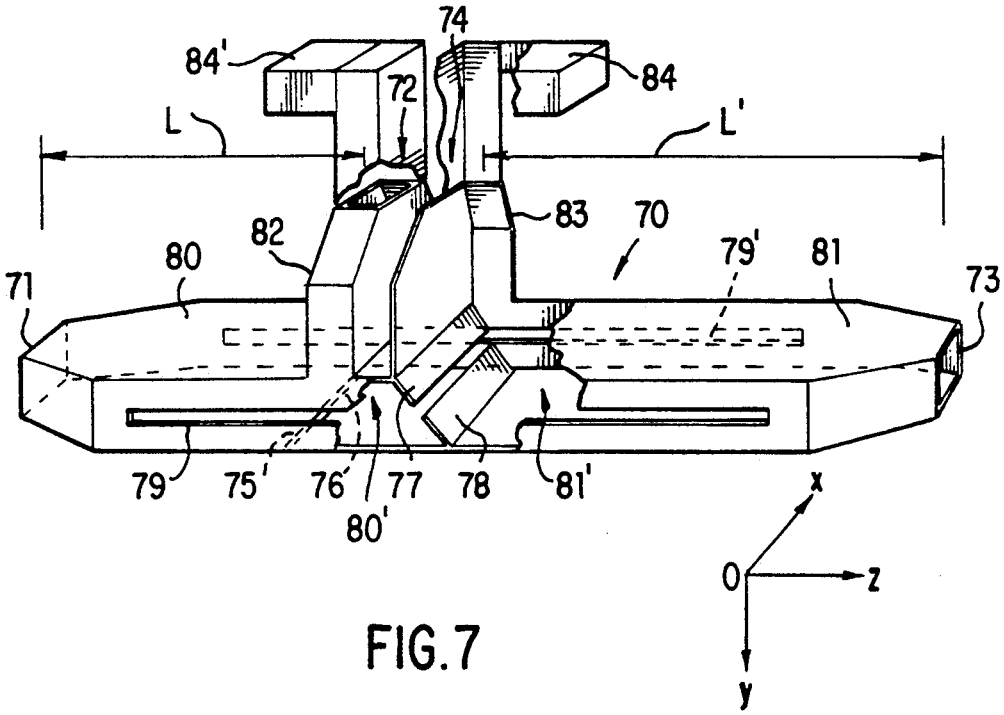
FIG. 7 is a perspective view, partially in section, of an other embodiment of the invention, having two adjacent vertical complementary portions of housing for injection of complementary microwave energy.

Referring to FIG. 7, it is shown an other embodiment of an housing 70, according to the invention, having two parts of housing 80 and 81, defining two 80' and 81' parts of parallepipedal cavity with dimensions a×b×L and a×b×L', aligned with each other. Two complementary portions of housing 82 and 83, vertical, are connected to parts 80 and 81, between the parts.

Inlet and outlet for microwaves in and out of the housing are indicated by references 71 to 74 on the figure. Due to the flaps 75, 76, 77 and 78 for deflecting the propagation paths of the microwaves, inlets (or outlet) 71 and 72, on one hand, and 73 and 74, on the other hand, are strongly coupled.

It is therefore possible to increase microwaves action in the centre part of the plane product, while providing microwaves generators 84 and 84' at the inlets 72 and 74 and adaptators at the outlets 71 and 73.

The microwave introduced at 72 goes towards 71, while the microwave introduced at 74 goes towards 73. This device has been tested for correcting and adjusting the thermic profile along the whole width of the plane product introduced through lateral rectangular slots 79 and 79', along plan Ox, Oz. The respective lengths L and L' of the two parts of housing 80 and 81 can be different.

An operating mode of the device according to the invention will now be briefly described whilst referring more particularly to FIG. 1.

A start is made by generating the excitation of the waveguide cavity at the frequency adopted, conventionally 2.45 GHz. This excitation is next adjusted so as to be matched with the technical specifics of the product to be treated, insofar as a margin is available for the adjustment. The product to be treated is next placed, in a manner known per se, on the endless support belt constituted for example by a composite conveyor belt made from a material known by the name TEFLON reinforced with glass fibres.

The speed of advance of the endless belt, in the case of continuous operation, or its rate of progress, in the case of batch operation, is next adjusted. A programmable automatic unit allows automatic control of the system. The product therefore passes into the housing, where it undergoes the chosen treatment, for the desired specified period.

As has been seen, the devices designed according to the invention possess better efficiencies, in both power and bulkiness, than the known devices. They likewise allow industrial performance of heat treatment operations till now poorly controlled with the technique using microwaves. They may allow, for example, a static surface treatment over an area of 100×200 mm, or a particularly homogeneous continuous treatment over a 250 mm wide strip.

They are likewise applicable, for example, to the treatment of products appearing in the form of spread-out packets, fibrils, or in the form of laps of elements of small thickness, of small-sized area (for example of the order of 5 to 10 cm2), uniformly distributed side by side, or close together, on an advancing belt.

The invention finds also a particularly interesting application in the field of the treatment of sheets of glass, including the drying of glaze on glass.

We claim:

1. Microwave applicator device for the treatment of sheet or lap products with microwaves comprising:

a housing defining a waveguide cavity, said housing comprising a first part of housing defining a parallelepipedal waveguide first part of cavity with dimensions A×B×L in an orthogonal coordinate system Ox, Oy, Oz, said first part of housing being aligned along Oz and provided with parallel slots aligned along at least one of the Ox, Oy plane and Oy, Oz plane for passing the sheet or lap products to be treated into the cavity along a plane parallel to the Ox, Oz, plane, the dimension A of said first part of cavity being greater than a value substantially equal to the dimension B of said first part of cavity, said first part of housing being connected to a first complementary portion of housing defining a first complementary portion of cavity extending outwardly of the Ox, Oz plane in an outwardly direction, said housing further comprising an end portion aligned along said first part of housing, located on the other side of said first complementary portion of housing with regard to said first part of housing, and arranged for trapping the microwaves which are not deviated in said first complementary portion of cavity, means for exciting the cavity in Transverse Electric single mode (TE), in order to create an electric field (E) internal to said first part of cavity along a direction substantially parallel to Ox, and means for deviating the direction of microwaves propagation between the microwaves direction parallel to the Ox, Oz plane, within said first part of housing, and said outwardly direction, within said first complementary portion of cavity.

2. Device according to claim 1, wherein said outwardly direction is a direction parallel to Oy.

3. Device according to claim 1, wherein the housing comprises:

a second complementary portion of housing defining a second complementary portion of cavity, located within a proximity of said first complementary portion of housing and extending outwardly of the Ox, Oz plane, and a second part of housing connected to said first part of housing and defining a parallelepipedal waveguide second part of cavity with dimensions A×B×L' in said orthogonal coordinate system Ox, Oy, Oz with said first part of housing, being aligned along Ox, Oz with said first part of cavity with regard to said first and second complementary portions of housing, and wherein said device comprises means for exciting the second part of cavity in a Transverse Electric single mode (TE), in order to create an electric field (E') internal to the said second part of cavity along a direction substantially parallel to Ox.

4. Device according to claim 1, further comprising a further part of housing aligned along the Ox, Oz plane, each of the first and further parts of housing being connected to a corresponding complementary portion of housing.

5. Device according to claim 3, further comprising a first microwave generating means for introducing microwaves at one end of the first part of cavity and a second microwave generating means for introducing microwaves at an end of the second part of cavity adjacent said one end of the first part of cavity.

6. Device according to claim 2, wherein the ration A/B is greater than 2.

7. Device according to claim 2, wherein the ration A/B is greater than 4.

8. Device according to claim 2, wherein it comprises means for advancing the products inside the cavity, in a direction parallel to Oz.

9. Device according to claim 2, wherein the device is of a resonant type for guiding resonant waves.

10. Device according to claim 9, wherein the resonant waves have antinodes, a length of the dimension B of the cavity is arranged to distribute the antinodes of the resonant wave in a longitudinal direction of said cavity, parallel to the axis Ox.

11. Device according to claim 2, wherein the dimension B of the cavity is close to a value equal of c/2f, where c is the speed of light in vacuo and f is the microwave frequency.

12. Device according to claim 2, wherein the housing defining the waveguide cavity comprises a removable cover in the form of a plate with longitudinal edges turned down parallel to the Oy, Oz plane, said longitudinal edges having a periphery being parallel to the Ox, Oz plane, the cover constituting a portion for the lid of the housing.

13. Device according to claim 12, characterized in that the periphery of the longitudinal edges of the cover coincides with the upper edge of the slots for passing the products to be treated into the cavity.

14. Device according to claim 2, wherein the means for exciting are adapted for exciting the cavity in a Transverse Electric single mode TE01.

* * * * *